US009585434B2

(12) United States Patent
Van Atta et al.

(10) Patent No.: US 9,585,434 B2
(45) Date of Patent: Mar. 7, 2017

(54) UPPER WITH SENSORY FEEDBACK

(71) Applicant: NIKE, Inc., Beaverton, OR (US)

(72) Inventors: Dylan S. Van Atta, Portland, OR (US); Patricia L. Smaldone, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 140 days.

(21) Appl. No.: 14/554,524

(22) Filed: Nov. 26, 2014

(65) Prior Publication Data

US 2016/0143395 A1 May 26, 2016

(51) Int. Cl.

| | |
|---|---|
| ***A43B 23/26*** | (2006.01) |
| ***A43B 5/02*** | (2006.01) |
| ***A43B 23/02*** | (2006.01) |
| ***A43B 5/16*** | (2006.01) |

(52) U.S. Cl.

CPC ..... *A43B 5/025* (2013.01); *A43B 5/16* (2013.01); *A43B 5/1625* (2013.01); *A43B 23/028* (2013.01); *A43B 23/0215* (2013.01); *A43B 23/0235* (2013.01); *A43B 23/0295* (2013.01)

(58) Field of Classification Search

CPC . A43B 23/227; A43B 23/0235; A43B 23/028; A43B 23/0295; A43B 5/00; A43B 5/02; A43B 5/025

USPC ..... 36/133

See application file for complete search history.

(56) References Cited

U.S. PATENT DOCUMENTS

| | | | | |
|---|---|---|---|---|
| 2,330,317 A | | 9/1943 | Stewart | |
| 3,191,321 A | * | 6/1965 | Brutting | A43B 5/02 36/133 |
| 4,715,133 A | | 12/1987 | Hartjes et al. | |
| 4,811,501 A | * | 3/1989 | Okayasu | A43C 13/14 36/77 R |
| 4,823,799 A | | 4/1989 | Robbins | |
| 5,607,749 A | | 3/1997 | Strumor | |
| 5,768,802 A | * | 6/1998 | Bramani | A43B 7/146 36/28 |
| 5,915,819 A | | 6/1999 | Gooding | |
| 5,946,825 A | | 9/1999 | Koh et al. | |
| 6,082,024 A | | 7/2000 | Del Biondi | |

(Continued)

FOREIGN PATENT DOCUMENTS

| | | |
|---|---|---|
| CA | 2052070 A1 | 1/1993 |
| DE | 8304272 U1 | 10/1983 |

(Continued)

OTHER PUBLICATIONS

International Search Report and Written Opinion of the International Searching Authority, for Application No. PCT/US2015/047956, mailed on Nov. 30, 2015, 14 pages.

(Continued)

*Primary Examiner* — Jila M Mohandesi

(74) *Attorney, Agent, or Firm* — Klarquist Sparkman, LLP

(57) ABSTRACT

An article of footwear includes projection members providing sensory feedback. The projection members are disposed on a base layer which is attached to an upper of an article of footwear. When the upper encounters a surface of an object, the projection members and base layer may be displaced in a direction towards wearer's foot. The projection members may be configured so that they are inserted into apertures located on the upper, and extend above the outer surface of the upper.

19 Claims, 11 Drawing Sheets

(56) References Cited

U.S. PATENT DOCUMENTS

| | | | | |
|---|---|---|---|---|
| 6,138,281 | A | 10/2000 | Chiaruttini | |
| 6,275,997 | B1 | 8/2001 | Richardson | |
| 6,516,540 | B2 | 2/2003 | Seydel et al. | |
| 6,523,282 | B1 * | 2/2003 | Johnston | A43B 5/02 36/133 |
| 6,691,432 | B2 | 2/2004 | Masseron | |
| 6,732,457 | B2 | 5/2004 | Gardiner | |
| 7,013,588 | B2 | 3/2006 | Chang | |
| 7,089,690 | B2 | 8/2006 | Krstic | |
| 7,140,129 | B2 * | 11/2006 | Newson | A43B 5/18 36/100 |
| 7,264,599 | B1 | 9/2007 | Milligan | |
| 7,290,357 | B2 | 11/2007 | McDonald et al. | |
| 7,346,936 | B2 | 3/2008 | Vargas et al. | |
| 7,665,229 | B2 | 2/2010 | Kilgore et al. | |
| 7,752,772 | B2 | 7/2010 | Hatfield et al. | |
| 7,849,609 | B2 | 12/2010 | Edington et al. | |
| 7,913,420 | B2 | 3/2011 | Arizumi | |
| 7,918,811 | B2 | 4/2011 | Lussier et al. | |
| 7,941,943 | B2 * | 5/2011 | Baker | A43B 5/02 36/133 |
| 8,006,411 | B2 | 8/2011 | Manz et al. | |
| 8,162,860 | B1 | 4/2012 | Ali | |
| 8,215,032 | B2 | 7/2012 | Sokolowski et al. | |
| 8,333,022 | B2 | 12/2012 | Crowley, II et al. | |
| 8,387,281 | B2 | 3/2013 | Loverin et al. | |
| 8,661,712 | B2 * | 3/2014 | Aveni | A43B 23/0215 36/3 A |
| 8,950,087 | B2 * | 2/2015 | Baucom | A43B 3/0031 36/100 |
| 2005/0188562 | A1 * | 9/2005 | Clarke | A43B 5/18 36/15 |
| 2005/0241189 | A1 * | 11/2005 | Elkington | A43B 3/0047 36/117.6 |
| 2006/0000119 | A1 | 1/2006 | Endo | |
| 2006/0048413 | A1 | 3/2006 | Sokolowski et al. | |
| 2007/0180730 | A1 | 8/2007 | Greene et al. | |
| 2008/0078106 | A1 | 4/2008 | Montgomery | |
| 2009/0083993 | A1 | 4/2009 | Plank | |
| 2010/0011620 | A1 | 1/2010 | Nakano | |
| 2010/0175276 | A1 | 7/2010 | Dojan et al. | |
| 2011/0252671 | A1 | 10/2011 | Maron et al. | |
| 2012/0023777 | A1 | 2/2012 | Greene | |
| 2012/0023786 | A1 | 2/2012 | Dojan | |
| 2012/0055047 | A1 | 3/2012 | Youngs | |
| 2012/0167414 | A1 | 7/2012 | Shrairman | |
| 2012/0240432 | A1 | 9/2012 | Lambertz | |
| 2012/0291315 | A1 | 11/2012 | Baucom et al. | |
| 2012/0317843 | A1 | 12/2012 | Bove | |
| 2013/0152424 | A1 | 6/2013 | Dojan | |
| 2015/0366281 | A1 | 12/2015 | Miller et al. | |
| 2016/0095389 | A1 | 4/2016 | Minami et al. | |

FOREIGN PATENT DOCUMENTS

| | | | |
|---|---|---|---|
| DE | 3520956 | A1 | 1/1987 |
| DE | 202010017958 | U1 | 6/2013 |
| EP | 1557105 | A1 | 7/2005 |
| EP | 2494879 | A1 | 9/2012 |
| EP | 2594146 | A1 | 5/2013 |
| JP | 5-115308 | A | 5/1993 |
| SU | 971240 | A1 | 11/1982 |
| WO | 9305674 | A1 | 4/1993 |
| WO | 2004/014171 | A1 | 2/2004 |
| WO | 2007087581 | A1 | 8/2007 |
| WO | 2015108593 | A1 | 7/2015 |
| WO | 2016085553 | A1 | 6/2016 |

OTHER PUBLICATIONS

International Search Report and Written Opinion for Application No. PCT/US2015/042822, mailed on Oct. 21, 2015, 15 pages.

International Search Report and Written Opinion for Application No. PCT/US2014/062104, mailed on Jan. 29, 2015.

International Search Report and Written Opinion mailed Oct. 21, 2015 for PCT Application No. PCT/US2015/042822.

Non Final Office Action mailed Jun. 2, 2016 for U.S. Appl. No. 14/503,891 filed Oct. 1, 2014.

* cited by examiner

UPPER WITH SENSORY FEEDBACK

BACKGROUND

The present embodiments generally relate to an article of footwear and in particular to an upper for an article of footwear.

Articles of footwear can generally be described as having two primary elements, an upper for enclosing the wearer's foot, and a sole structure attached to the upper. The upper generally extends over the toe and instep areas of the foot, along the medial and lateral sides of the foot and around the back of the heel. The upper generally includes an ankle opening to allow a wearer to insert the wearer's foot into the article of footwear.

The sole structure is attached to a lower portion of the upper and is positioned between the upper and the ground. Generally, the sole structure may include an insole, a midsole, and an outsole. The insole is in close contact with the wearer's foot or sock, and provides a comfortable feel to the sole of the wearer's foot. The insole is in close contact with the wearer's foot or sock, and provides a comfortable feel to the sole of the wearer's foot. The midsole generally attenuates impact or other stresses due to ground forces as the wearer is walking, running, jumping, or engaging in other activities. The outsole may be made of a durable and wear resistant material, and it may carry a tread pattern to provide traction against the ground or playing surface.

SUMMARY

In one aspect, an article of footwear includes an upper and a sole structure secured to the upper. The upper has an outwardly facing surface and an inwardly facing surface opposite the outwardly facing surface. The upper further includes a first aperture. The article further includes a projection member system having a base layer. The base layer comprises of a peripheral portion, an interior portion disposed inwardly of the peripheral portion, a first side, a second side opposite the first side. The projection member system includes a first projection member integrally formed with the base layer. The first projection member extends away from the first side and the second side of the base layer. The first projection member is disposed in a first aperture and extends distally of the outwardly facing surface of the upper. The peripheral portion of the base layer is attached to the upper. The projection member system has a first configuration where a proximal end of the first projection member is disposed a first distance from the inwardly facing surface of the upper. The projection member system has a second configuration where the proximal end of the first projection member is disposed a second distance from the inwardly facing surface of the upper, where the second distance is greater than the first distance. The peripheral portion of the base layer is attached to the inwardly facing surface in the first configuration and the second configuration. The interior portion of the base layer moves further from the inwardly facing surface between the first configuration and the second configuration.

In another aspect, an article of footwear includes an upper and a sole structure secured to the upper. The upper has an outwardly facing surface and an inwardly facing surface opposite the outwardly facing surface, and a first aperture. The article further includes a projection member system including a base layer. The base layer comprising a peripheral portion and, an interior portion disposed inwardly of the peripheral portion, where the base layer also includes a first side and a second side opposite the first side. The projection member system also includes a first projection member, the first projection member including a proximal end and a distal end. The projection member system includes a first connecting portion, where the first connecting portion includes a first connecting end attached to the base layer and includes a second connecting end attached to the first projection member, where the second connecting end is attached to the first projection member between the proximal end and the distal end. The first connecting portion includes an intermediate connecting portion that is disposed between the first connecting end and the second connecting end. A portion of the first projection member including the distal end is disposed through the first aperture. The first side of the base layer is fixed to the inwardly facing surface of the upper. The intermediate connecting portion of the first connecting portion is capable of moving relative to the inwardly facing surface. The first projection member can be displaced in the proximal direction when a force is applied to the distal end of the first projection member.

In another aspect, an article of footwear includes an upper and a sole structure secured to the upper. The upper has an outwardly facing surface, an inwardly facing surface opposite the outwardly facing surface, the upper further including an aperture. The article further includes a projection member having a proximal end and a distal end. The projection member is configured to retract towards an interior of the upper when a force is applied to the distal end. The proximal end is configured to contact a foot when the projection member retracts thereby alerting a wearer of the article of footwear to the force applied at the distal end.

Other systems, methods, features and advantages of the embodiments will be, or will become, apparent to one of the ordinary skill in the art upon examination of the following figures and detailed description. It is intended that all such additional systems, methods, features and advantages be included within this description and this summary, be within the scope of the embodiments, and be protected by the following claims.

BRIEF DESCRIPTION OF DRAWINGS

The embodiments can be better understood with reference to the following drawings and description. The components in the figures are not necessarily to scale, emphasis instead being placed upon illustrating the principles of the embodiments. Moreover, in the figures, like reference numerals designate corresponding parts throughout different views.

DETAILED DESCRIPTION OF DRAWINGS

Figure 1:
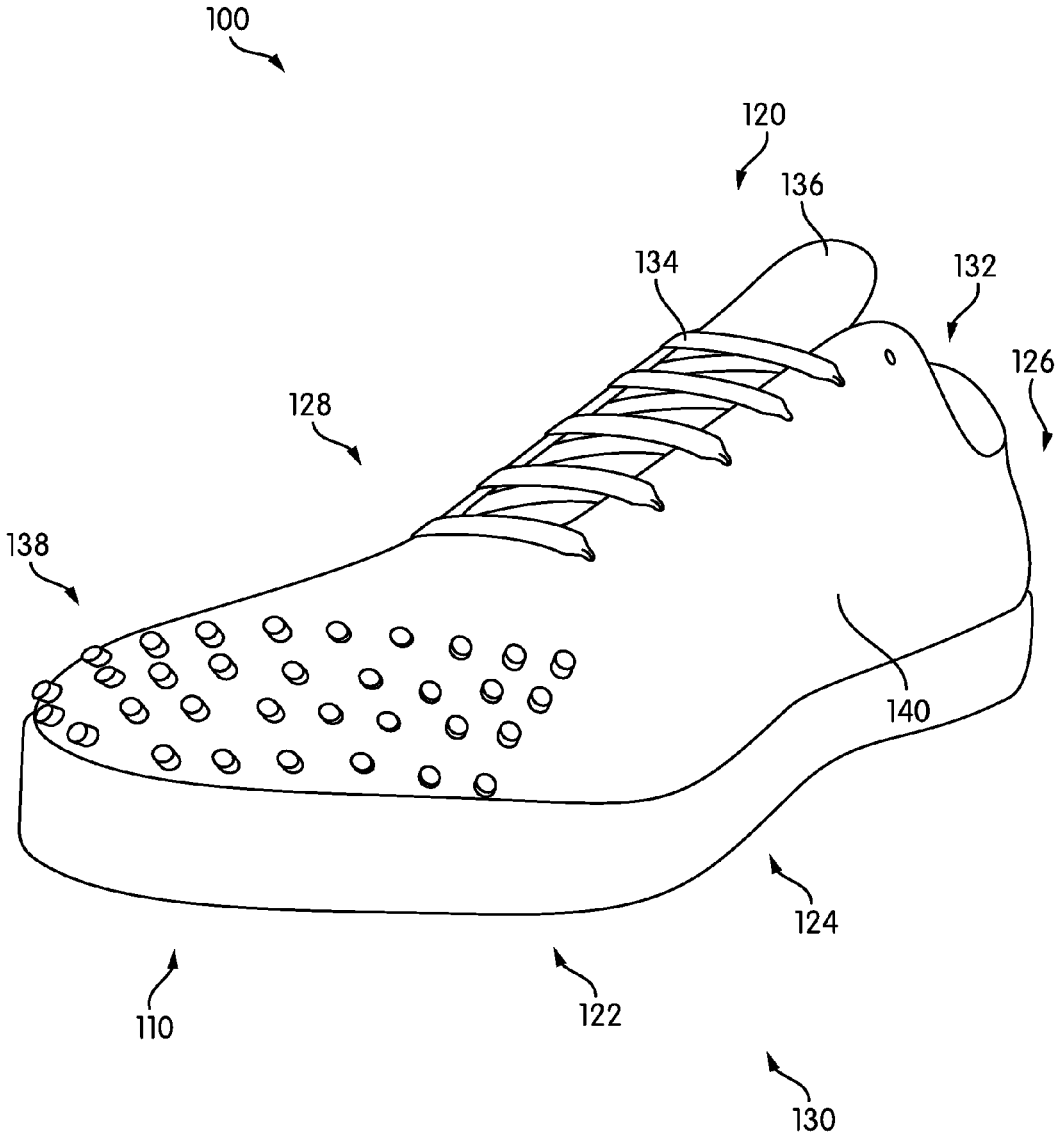
FIG. 1 is an isometric medial view of an embodiment of an article of footwear.

For clarity, the detailed descriptions herein describe certain exemplary embodiments, but the disclosure in this application may be applied to any article of footwear comprising certain features described herein and recited in the claims. In particular, although the following detailed description describes certain exemplary embodiments, it should be understood that other embodiments may take the form of other articles of athletic or recreational footwear.

For convenience and clarity, various features of embodiments of an article of footwear may be described herein by using directional adjectives such as top, bottom, medial, lateral, forward, rear, and so on. As used herein, the term "inward direction" is a direction extending towards an interior of an article (i.e., towards an interior cavity of an upper of the article). In some cases, the term "proximal" may likewise be used to indicate a component oriented relatively inward of another component. Similarly, as used herein, the term "outward direction" is a direction extending towards an exterior of an article. In some cases, the term "distal" may likewise be used to indicate a component oriented relatively outward, or away from, another component, with respect to an interior of the article. Such directional adjectives refer to the orientation of the article of footwear as typically worn by a wearer when standing on the ground, unless otherwise noted. The use of these directional adjectives and the depiction of articles of footwear or components of articles of footwear in the drawings should not be understood as limiting the scope of this disclosure in any way.

FIG. 1 depicts an embodiment of an article of footwear 100, also referred to hereafter simply as article 100. Article 100 may include a sole structure 110 and an upper 120. For reference purposes, article 100 may be divided into three general regions: a forefoot region 122, a midfoot region 124, and a heel region 126. Forefoot region 122 generally includes portions of article 100 corresponding with the toes and the joints connecting the metatarsals with the phalanges. Midfoot region 124 generally includes portions of article 100 corresponding with an arch area of the foot. Heel region 126 generally corresponds with rear portions of the foot, including the calcaneus bone. Article 100 also includes a lateral side 128 and a medial side 130 extending through forefoot region 122, midfoot region 124, and heel region 126. Forefoot regions 122, midfoot region 124, heel region 126, lateral side 128, and medial side 130 are not intended to demarcate precise areas of article 100. Rather, they are intended to represent general relative areas of article 100 to aid in the following discussion.

Since sole structure 110 and upper 120 both span substantially the entire length of article 100, the terms forefoot region 122, midfoot region 124, heel region 126, lateral side 128 and medial side 130 apply not only to article 100 in general, but also to sole structure 110 and upper 120, as well as the individual elements of sole structure 110 and upper 120.

As shown in FIG. 1, upper 120 may include one or more material elements (for example, suede, textiles, foam, leather, and synthetic leather), which may be stitched, adhesively bonded, molded, or otherwise formed to define an interior void configured to receive a foot. The material elements may be selected and arranged to selectively impart properties such as durability, air-permeability, wear-resistance, flexibility, and comfort. An ankle opening 132 in heel region 126 provides access to the interior void. In addition, upper 120 may include a lace 134, which may be utilized to modify the dimensions of the interior void, thereby securing the foot within the interior void and facilitating entry and removal of the foot from the interior void. Lace 134 may extend through apertures in upper 120, and a tongue portion 136 of upper 120 may extend between the interior void and lace 134. Tongue portion 136 may be low and padded to provide comfort. Upper 120 may alternatively implement any of a variety of other configurations, materials, and/or closure mechanisms. For example, upper 120 may include sock-like liners instead of a more traditional tongue; alternative closure mechanisms, such as hook and loop fasteners (for example, straps), buckles, clasps, cinches, or any other arrangement for securing a foot within the void defined by upper 120.

Sole structure 110 may be fixedly attached to upper 120 (for example, with adhesive, stitching, welding, and/or other suitable techniques) and may have a configuration that extends between upper 120 and the ground (not shown). Sole structure 110 may include provisions for attenuating ground reaction forces (that is, cushioning the foot). In addition, sole structure 110 may be configured to provide traction, impart stability, and/or limit various foot motions, such as pronation, supination, and/or other motions. The configuration of sole structure 110 may vary significantly according to one or more types of ground surfaces on which sole structure 110 may be used, for example, natural turf, synthetic turf, dirt, pavement (for example, asphalt, concrete, and other types of pavement), as well as indoor surfaces, such as hardwood, synthetic rubber surfaces, tile, and other indoor surfaces. In addition, the configuration of sole structure 110 may vary significantly based according to the type of activity for which article 100 is anticipated to be used (for example, running, walking, soccer, baseball, basketball, and other activities).

Figure 2:
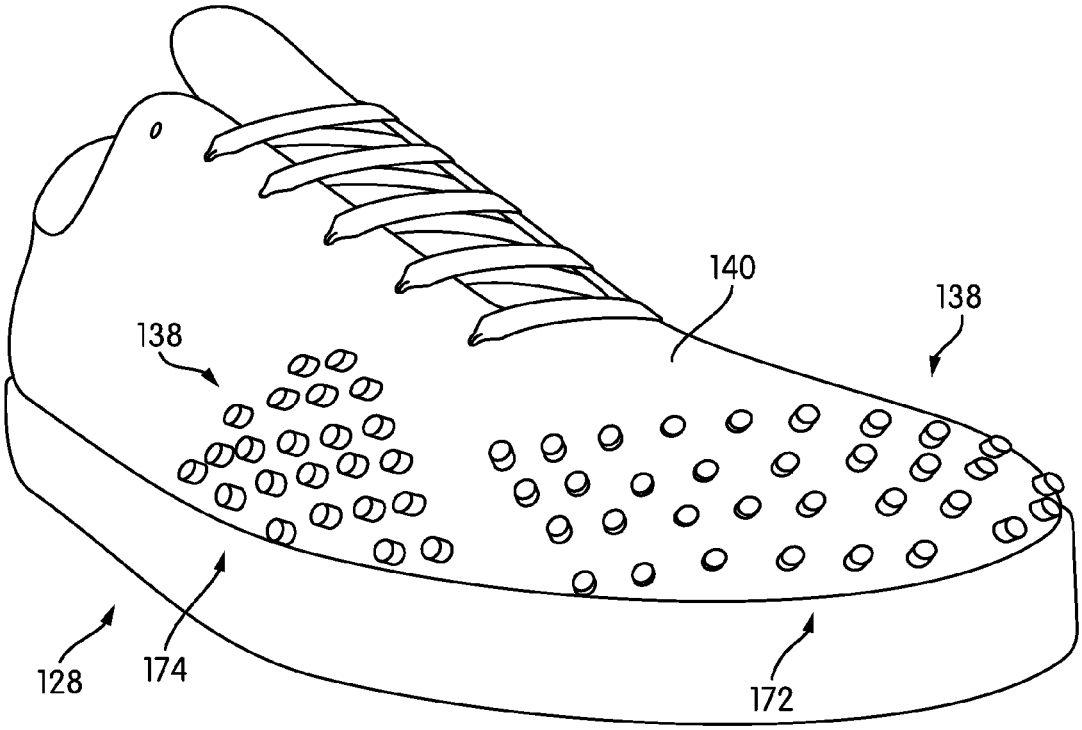
FIG. 2 is an isometric lateral view of an embodiment of an article of footwear.

Article 100 is depicted in the accompanying figures as a shoe, having an upper 120 with a textured surface 138 (as shown, for example, in FIGS. 1 and 2). Textured surface 138 may be suited for engaging in activities where the upper 120 encounters abrasive surfaces, for example skateboarding. In some embodiments, textured surface 138 may be disposed in the forefoot region 122 and lateral side 128 of upper 120. In some other embodiments, textured surface 138 may be disposed in other parts of upper 120. Although article 100, as depicted, may be suited for activities where upper 120 may encounter an abrasive surface, such a shoe may be applicable for use in other activities. Further, many of the features of article 100 discussed herein may be applicable to other types of articles.

In some embodiments, upper 120 may be characterized as having an outwardly facing surface 140 (as shown, for example, in FIGS. 1 and 2) and an inwardly facing surface 142 (as shown, for example, in FIG. 6) opposite outwardly facing surface 140. Inwardly facing surface 142 forms an interior part of upper 120 and thus may be disposed closer to a foot of a user when worn. In contrast, outwardly facing surface 140 forms the exterior parts of upper 120 which may come into contact with a surface of an object.

Figure 3:
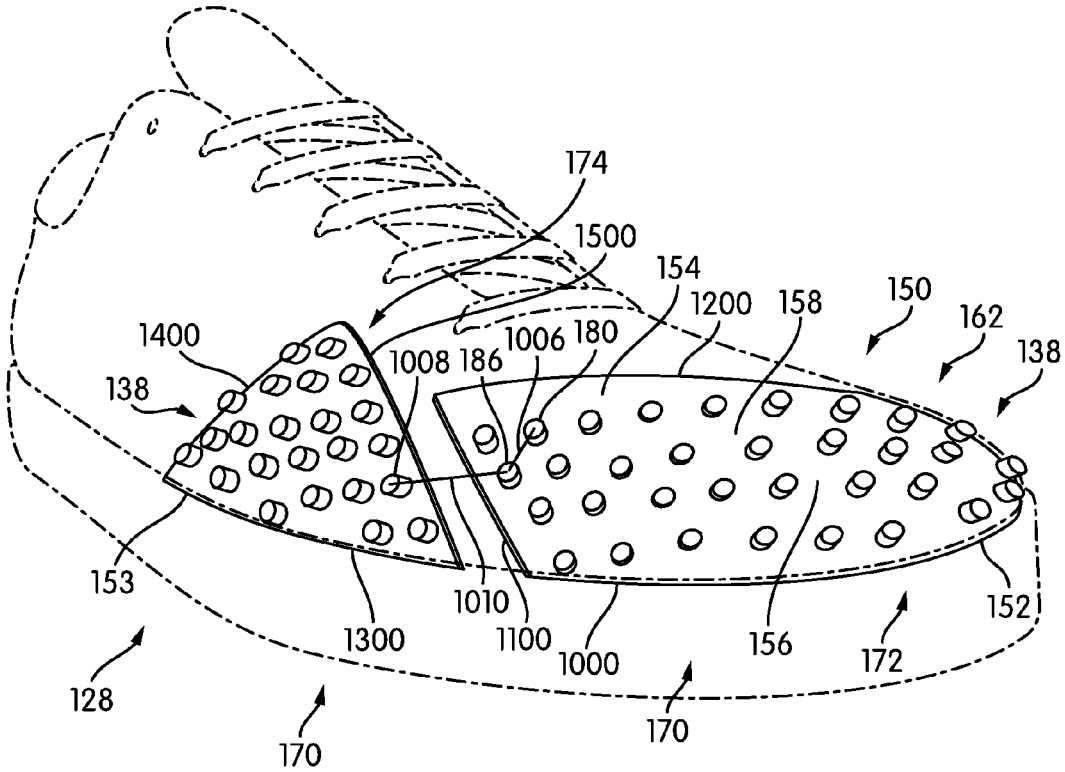
FIG. 3 is an isometric lateral view of a plurality of base layers, with a plurality of projection members, and engagement zones.
Figure 4:
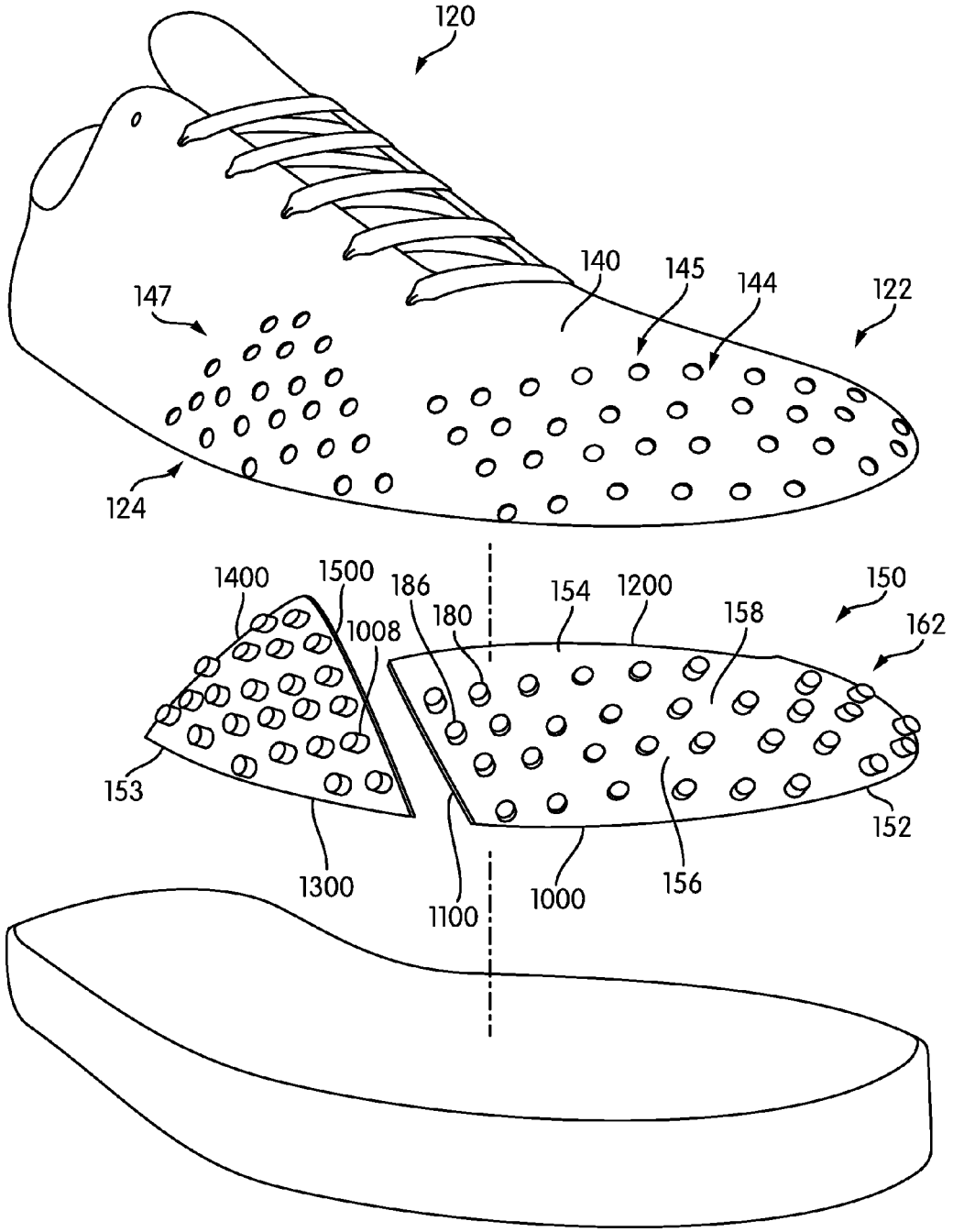
FIG. 4 is an isometric exploded lateral view of a plurality of base layers, with a plurality of projection members, and engagement zones.

Referring to FIGS. 3 and 4, in some embodiments, upper 120 may be characterized further as having a plurality of apertures 144. In some embodiments, apertures 144 may be disposed in midfoot region 124 (e.g., midfoot apertures 145), and forefoot region 122 (e.g., forefoot apertures 147). In other embodiments, apertures 144 may be on the lateral side 128. In some other embodiments, apertures 144 may be disposed in other parts of upper 120. In some embodiments, apertures 144 may be regularly spaced and arranged in a predetermined pattern. In some other embodiments, apertures 144 may be randomly spaced.

In some embodiment, upper 120 may include provisions, which may individually and/or collectively provide article 100 with a number of attributes. In some cases the attributes may be associated with the transmission of a tactile sensation of an object in contact with outwardly facing surface 140 of upper 120 when the article of article 100 is worn. Attributes may further include an ability to control an object as upper 120 interacts with the object's surface. In some embodiments, these provisions may include textured surface 138 formed by apertures 144, and a projection member system 150 as shown in FIGS. 3 and 4.

In some embodiments, projection member system 150 may have at least one structure that is a base layer. For example, a first base layer 152 may include first edge 1000, second edge 1100, and third edge 1200 which may define a boundary for first base layer 152. In some embodiments, first base layer 152 may have additional edges. First base layer 152 may also include a peripheral portion 154 extending around the perimeter of first base layer 152 and an interior portion 156 located within a central area of first base layer 152. First base layer 152 may further include a first side 158 and an opposite second side 160 (as shown for example in FIG. 6). In some embodiments, first side 158 may be adjacent to inwardly facing surface 142 of upper 120, while second side 160 may be disposed closer to a foot of a user when worn. In some other embodiments, a second base layer 153 may be present. Second base layer 153 may have a boundary defined by fourth edge 1300, fifth edge 1400, and sixth edge 1500.

In some embodiments, first base layer 152, also referred to simply as base layer 152 for purposes of convenience, may have a certain thickness throughout. As used here, the thickness of a base layer may refer to a dimension extending from a first side of the layer to a second side of the layer (e.g., first side 158 to second side 160 of base layer 152). In some cases, peripheral portion 154 may have a first thickness, and interior portion 156 may have a second thickness. In some embodiments, the first thickness and the second thickness may be uniform throughout base layer 152, as illustrated in FIGS. 3 through 13. In some other embodiments, the first thickness may be greater than the second thickness, or vice versa.

In some embodiments, base layer 152 may have a substantially flat 2-dimensional geometry with a length and a width. In some embodiments, the length and the width may be greater than the first thickness and the second thickness of base layer 152.

In some embodiments, base layer 152 may come in a variety of shapes and sizes. For example, as shown in FIG. 3, base layer 152 may have a substantially triangular shape or a semi-elliptical shape. In other embodiments, the size and shape of base layer 152 could be selected according to various factors including the location of base layer 152 within upper 120, the desired configuration of projecting members on upper 120, as well as possibly other factors.

In some embodiments, base layer 152 may be made from materials which allow it to deform when encountering a load or force and then revert back to its original shape once the load is removed. In some embodiments base layer 152 is made from a material having elastomeric properties. In other embodiments, base layer 152 could be made of any other material according to desirable material characteristics (e.g., elasticity, rigidity, resilience, strength, etc.) for base layer 152.

In some embodiments, projection member system 150 may further include a plurality of projection members. Projection members may be disposed in an interior portion of a base layer and may extend away from either side of a base layer. For example, base layer 152 includes projection members 162. Projection members 162 may be disposed on the interior portion 156 of base layer 152 and extend away from first side 158 and second side 160 of base layer 152. In one embodiment, projection members 162 may extend in an approximately perpendicular direction from (i.e., projection members 162 may be approximately normal to) first side 158 and second side 160 (as shown for example in FIG. 6). Projection members 162 may be regularly spaced from each other and arranged in a predetermined pattern. In some other embodiments, projection members 162 may be arranged in a random pattern and therefore irregularly spaced. In still some other embodiments, projection members 162 may be densely spaced or more concentrated in some areas of base layer 152. It will be understood that second base layer 153 may incorporate similar projection members in any configuration described above for projection members 162 of base layer 152.

In some embodiments, projection members 162 may be made from a material having relatively high frictional properties. As used herein, high frictional properties could be determined relative to the frictional properties of an upper. In other words, projection members 162 may have high friction properties (or high grip) when projection members 162 have a higher amount of friction with objects (e.g., a skateboard) than an outer layer of upper 120. Projection members 162 made from a material having high friction properties may enable a user wearing article 100 to increase their grip on an object's surface thereby creating frictional forces and in turn reduce slipping. In some embodiments, projection members 162 may be made from an elastomeric material. In some other embodiments, projection members 162 may be made from a silicon carbide material. In some embodiments, projection members 162 may be integrally formed with base layer 152 forming a substantially monolithic component.

The embodiments may alternatively make use of configurations of projection members arranged in a matrix-like configuration. Specifically, the embodiments could make use of any of the configurations, components, systems and/or method disclosed in Meschter, U.S. Patent Publication No. 20,150,196,087, published on Jul. 16, 2015, titled "Sole System Having Movable Protruding Members," (now U.S. patent application Ser. No. 14/156,491, filed on Jan. 16, 2014), the entirety of which application is herein incorporated by reference.

Figure 6:
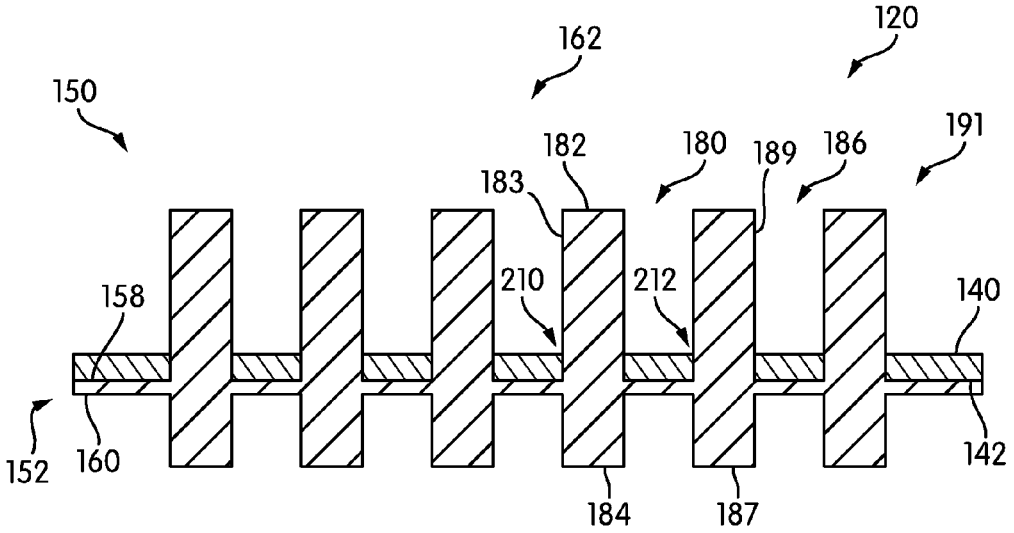
FIG. 6 is a side schematic view of an embodiment of a portion of a projection member system.

Referring to the exploded view of FIG. 4, in some embodiments, base layer 152 with projection members 162 may be configured to attach to upper 120, such that first side 158 of base layer 152 is in contact with inwardly facing surface 142 of upper 120 (as shown for example in FIG. 6). In addition, projection members 162 are disposed in apertures 144 such that projection members 162 extend above the outwardly facing surface 140 forming textured surface 138 (as shown for example in FIG. 3). It is to be understood that the number of apertures 144 and the number of projection members 162 correspond to each other. In other words, for each aperture there is a corresponding projection member that is to be placed in said aperture and extend above outwardly facing surface 140.

Base layer 152 may be attached to inwardly facing surface 142 of upper 120 using various methods known in the art, for example, adhesive bonding, stitching, fusing, and welding. In some embodiments, base layer 152 may be secured to upper 120 in the peripheral portion 154 only. In another embodiment, base layer 152 may be attached to upper 120 only by insertion of projection members 162 into apertures 144. With this type of configuration, base layer 152 may be detachable (and removable) from upper 120.

Referring to FIGS. 3 and 4, in some embodiments, projection members 162 may be configured in one or more engagement zones on upper 120. The term, "engagement zone" as used herein and in the claims may be defined as an area, location, region, portion, or side of the upper where projection members 162 are disposed in apertures 144 and extend above or distally of outwardly facing surface 140 of upper 120, and thereby form textured surface 138.

In some embodiments upper 120 may have multiple engagement zones 170. In an exemplary embodiment, upper 120 may have first engagement zone 172, and second engagement zone 174, as shown in FIGS. 2 and 3. In some embodiments, first engagement zone 172 may be an area defined by an outer peripheral boundary. In some embodiments, the outer peripheral boundary may be determined by projection members 162 visible on the upper from first base layer 152. In particular, in some cases, the outer peripheral boundary of first engagement zone 172 may be associated with a group of peripheral projection members disposed on first base layer 152. In some embodiments, second engagement zone 174 may be defined by a different outer peripheral boundary associated with projection members 162 visible on the upper from second base layer 153. Specifically, the outer peripheral boundary of second engagement zone 174 may be associated with a group of peripheral projection members disposed on second base layer 153.

In an exemplary embodiment, first engagement zone 172 may be associated in the forefoot region 122 of upper 120 in the vicinity of the toe or instep areas, and second engagement zone 174 may be associated near midfoot region 124 on lateral side 128 of upper 120. In some other embodiments, upper 120 may have areas where no engagement zone or projection members 162 are present, for example in the heel region 126 of upper 120.

In some embodiment, the location of projection members 162 and engagement zones 170 may generally be located where upper 120 is likely to come in contact with a surface of an object (e.g. a skateboard). Thus, the projection members may be located in the forefoot region, or optionally in the midfoot region of an article, between the top edge of the sole and the boundary of the lacing region.

In some embodiments, projection members may be spaced apart from adjacent projection members by various distances. In some embodiments, the distance between any two adjacent projection members within an engagement zone may be less than the distance between any two adjacent projection members located in different engagement zones. For example, as shown in FIG. 3, within first engagement zone 172, first projection member 180 may be spaced apart from second projection member 186 by first horizontal distance 1006. First horizontal distance 1006 may be characterized as any horizontal distance between two or more adjacent projection members within an engagement zone.

In some embodiments, third projection member 1008 located in second engagement zone 174, may be spaced apart from second projection member 186 located in first engagement zone 172, by second horizontal distance 1010. Second horizontal distance 1010 may be characterized as any horizontal distance between any two adjacent projection members located in different engagement zones. As seen in FIG. 3, the spacing between adjacent projection members within an engagement zone (e.g., first horizontal distance 1006) may be less than the spacing between two nearby projection members of different engagement zones (e.g., second horizontal spacing 1010). The spacing of adjacent projection members, both within an engagement zone and between different engagement zones may vary and provide distinct advantages for a user interacting with an object, as further discussed below.

Figure 5:
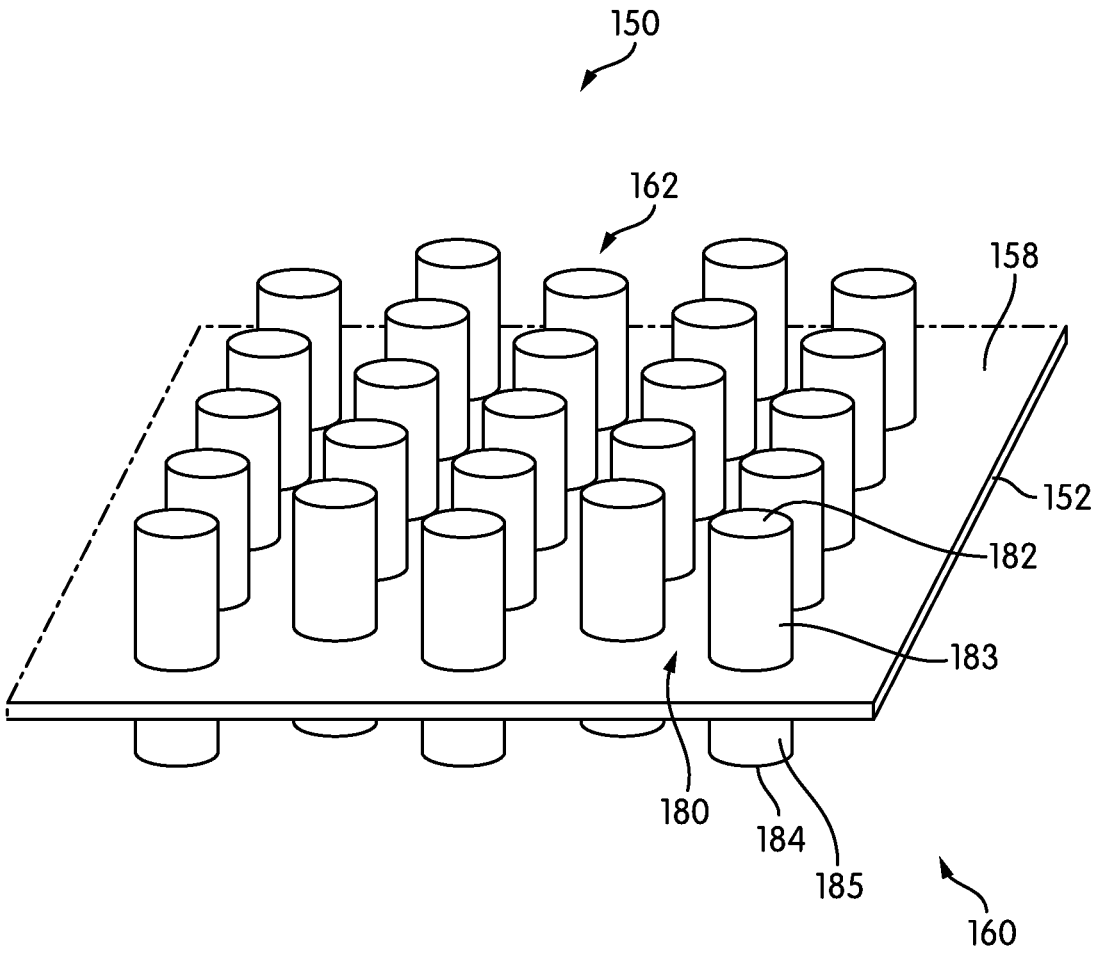
FIG. 5 is an isometric view of an embodiment of a base layer structure with an embodiment of a projection member system.

Referring to FIG. 5, an isometric view of a portion of an exemplary projection member system 150 having base layer 152 with projection members 162 is shown. In some embodiments, projection members 162 may comprise of at least first projection member 180 having a distal projecting portion 183 with distal end 182, and proximal projecting portion 185 with proximal end 184. Distal projecting portion 183 may extend outwardly from first side 158 of base layer 152. In contrast, proximal projecting portion 185 may extend outwardly from second side 160 of base layer 152.

As stated earlier, in some embodiments, base layer 152 and projection member 162 may be made from materials with elastomeric properties. In contrast, in some embodiments, upper 120 may be made from a material with a more rigid or stiff property, suitable for encountering abrasive surfaces. With this combination, when upper 120 encounters a force, base layer 152 may deform, allowing projection members 162 to transmit tactile information to a user's foot, while the more rigid upper 120 retains its shape.

Figure 7:
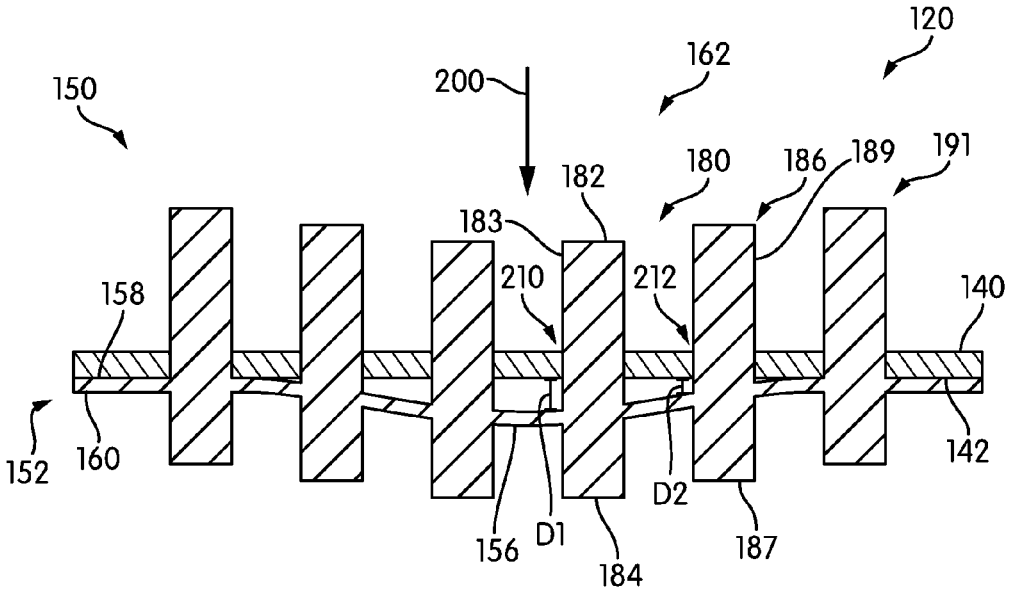
FIG. 7 is a side schematic view of an embodiment of a portion of a projection member system experiencing a load placed upon it.

FIGS. 6 and 7 illustrate an exemplary embodiment of article 100 having an upper 120 with projection member system 150 coming into contact with an object. In some embodiments, projection members 162 of projection member system 150 may retract or undergo deformation from an initial position when experiencing a force or load 200 as an engagement zone comes into contact with a surface of an object.

Referring to FIG. 6, projection members 162 including first projection member 180, and second projection member 186 are shown in an unloaded state (e.g., a first configuration), that is, no force is yet applied. In some embodiments, projection members 162 are illustrated as having equal lengths relative to first side 158 and second side 160 of base layer 152. In some embodiments, first projection member 180 may be disposed in first aperture 210. In some embodiments, second projection member 186 may be disposed in second aperture 212. As seen here, distal projecting portion 183 of first projection member 180 extends above outwardly facing surface 140 of upper 120. Similarly, a distal projecting portion 189 of second projecting member 186 extends above outwardly facing surface 140 of upper 120. Furthermore, first side 158 of base layer 152 is shown as being in contact with inwardly facing surface 142 of upper 120.

In some embodiments, when upper 120 comes into contact with a surface of an object (not shown) thereby engaging distal end 182 of first projection member 180, pressure from the contact causes load 200 to push against first projection member 180. This causes distal projecting portion 183 to retract a first distance D1 from inwardly facing surface 142 as shown in FIG. 7. Thus, FIG. 7 shows projection members 162 in a loaded state (e.g. a second configuration).

In some embodiments, because of the monolithic structure of base layer 152 with projection members 162, load 200 may cause the distal projecting portion 189 of second projection member 186 to retract a second distance D2 from inwardly facing surface 142. Specifically, as distal projecting portion 183 is pushed inwardly, first projecting member 180 may pull on second projection member 186 since they are commonly attached to base layer 152. In some cases, first distance D1 and second distance D2 may be substantially different as first projection member 180 and second projection member 186 experience a load. In particular, because base layer 152 is elastic, base layer 152 may stretch thereby reducing the degree to which second projecting member 186 may be pulled inwardly by first projecting member 180.

In some embodiments, not all projection members in an engagement zone will be displaced even as a projection member system is in loaded state. In some cases, the elastic properties of a base layer may allow some projection members to move substantially independently from other projection members when experiencing a load. As shown in FIG. 7, for example, in some embodiments, while first projection member 180 and second projection member 186 are displaced, third projection member 191 is not displaced by load 200.

In some embodiments, as first projection member 180, and second projection member 186 retract first distance D1 and second distance D2 respectively, the proximal ends of these members may transmit tactile sensation to a user's foot (not shown). For example, proximal end 184 of first projection member 180 may transmit tactile sensation to a foot. Likewise, proximal end 187 of second projection member 186 may also transmit tactile sensation to a foot. As projection members 162 are displaced due to load 200, this enables projection member system 150 to provide the user with sensory information relative to the object being encountered. In some cases, where projection members 162 are made from a high frictional material, this allows article 100 to interact with the surface of the object encountered allowing the user to control the surface of the object.

Figure 8:
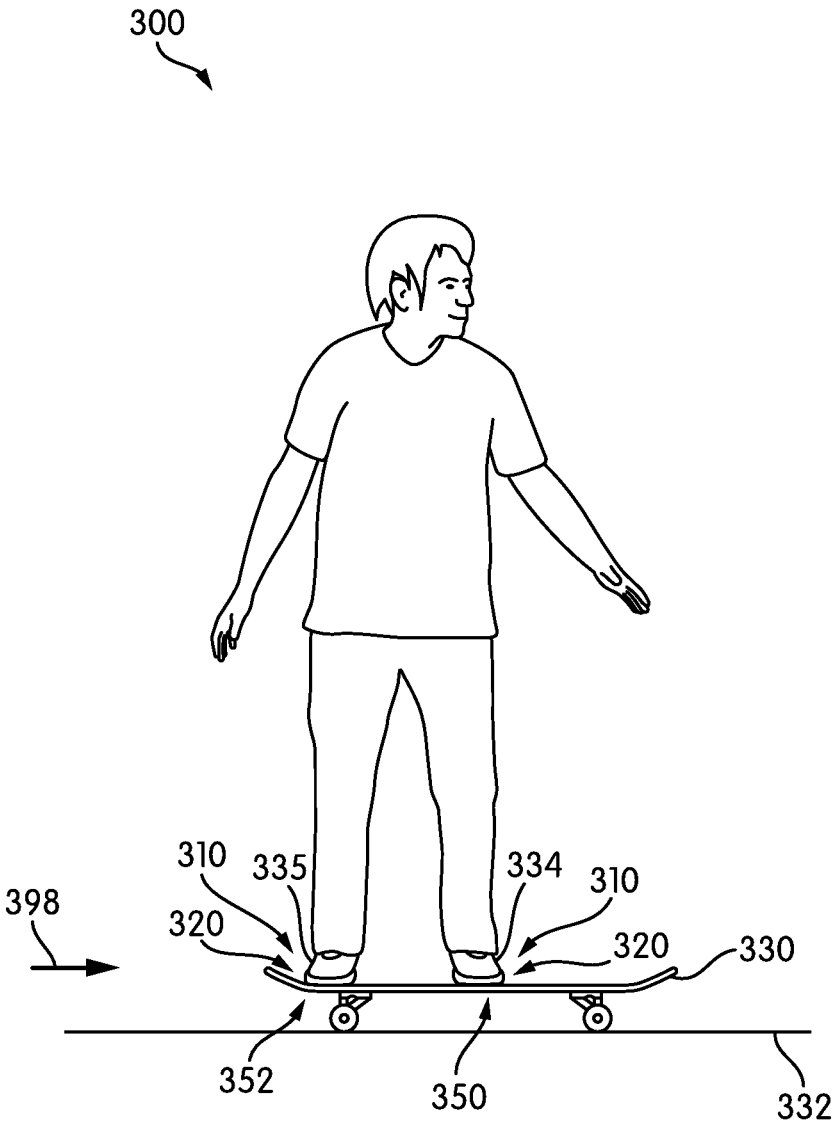
FIG. 8 is a schematic view of a user wearing articles of footwear having an embodiment of a projection member system.
Figure 9:
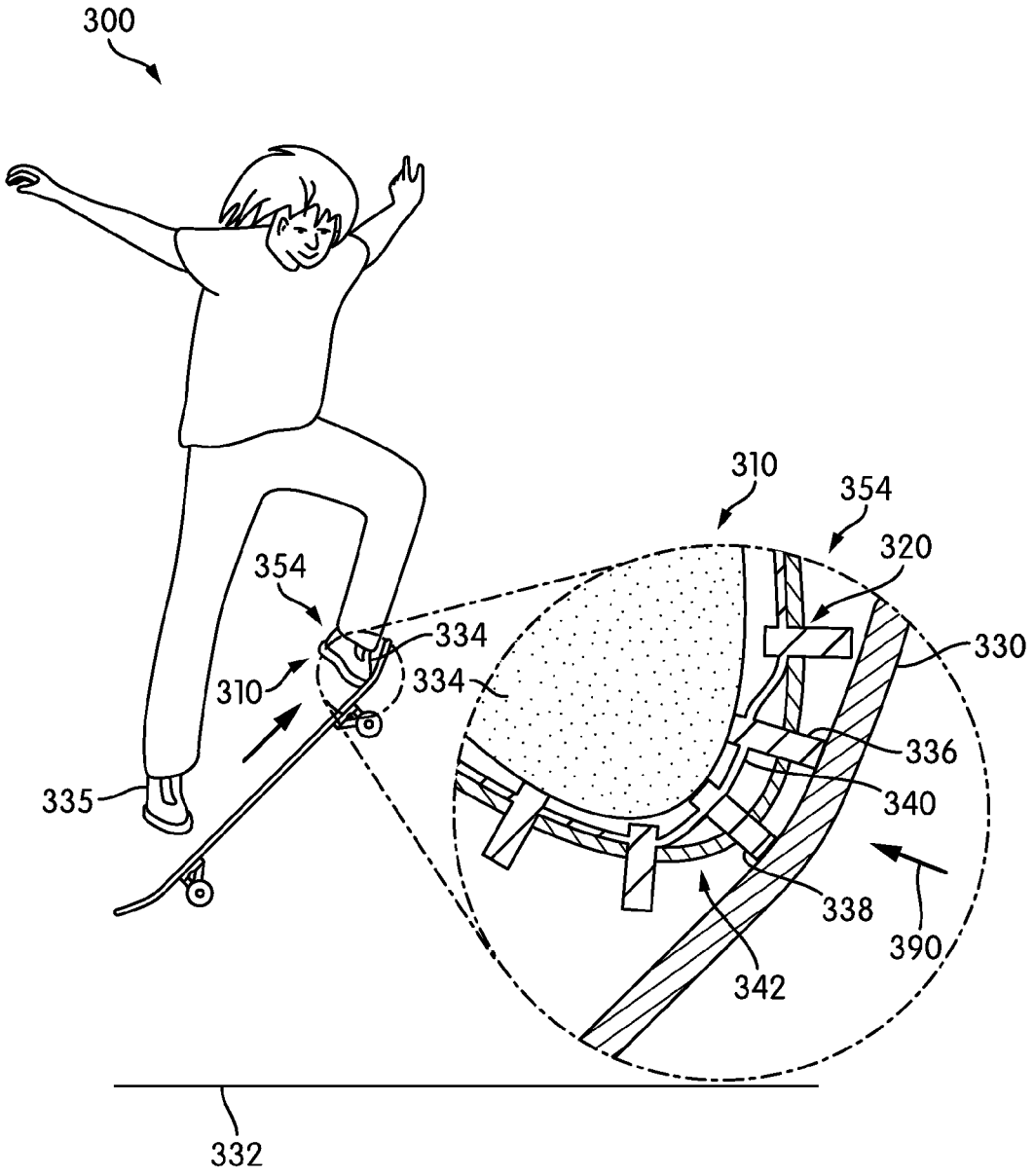
FIG. 9 is a schematic view of a user wearing article of footwear having an embodiment of a projection member system experiencing a load placed upon it.

FIGS. 8 and 9 illustrate schematic views of a user 300 wearing article 310 having an embodiment of a projection member system 320. In some embodiments, user 300 wearing article 310 may be able to detect and/or manipulate the surface of an object being encountered. In some embodiments, article 310 with projection member system 320 is useful in providing sensory perception and feedback of an object in relation to a user's foot. This sensory perception and feedback may aid user 300 in controlling an object.

User 300, as shown in FIG. 8, is participating in activities involving a skateboard 330. In some embodiments, skateboard 330 may comprise of a deck made of a wooden surface with wheels attached, and may come in a variety of shapes and sizes. Skateboard 330 may have a forward end oriented towards the front and rearward oriented towards the back. Skateboard 330 may also include a grip tape (not shown) which is a material having an adhesive on one side for attaching to portions of the deck and an opposite abrasion-resistant side, which allows a user's feet to grip the surface and help the user stay on board while riding or performing skateboard activities. One such popular skateboarding activity involves performing maneuvers where a user elevates the skateboard off the ground surface such that no part of the skateboard is in contact with a ground surface. In some cases, the user performs other maneuvers while the user and the skateboard are elevated.

In some embodiments, having article 310 with projection member system 320 providing sensory feedback may enable user 300 to recognize or be made aware of skateboard 330 location or other parts of skateboard 330 relative to user's 300 feet. This in turn provides better control and balance during skateboarding activities.

Referring to FIGS. 8 and 9, user 300 is depicted performing an exemplary skateboarding maneuver. In some embodiments, prior to executing the maneuver, user 300 may be in motion 398 and positioned on skateboard 330 such that left foot 334 is in first position 350, and right foot 335 is in second position 352. As user 300 initiates the maneuver, user 300 pushes down on rearward end of skateboard 330 with a right foot 335 causing skateboard 330 to elevate off of, and at an angular direction relative to ground surface 332.

As illustrated in the enlarged view in FIG. 9, in some embodiments, as user 300 continues the maneuver, left foot 334 moves forward to third position 354, while first projection member 336 and second projection member 338 of projection member system 320 come into contact with skateboard 330. Contact between skateboard 330 and article 310 causes first projection member 336, second projection member 338, and interior portion 340 of base layer 342 to be displaced by load 390. Furthermore, the contact between projection member system 320 and skateboard 330 and subsequent retraction of first projection member 336 and second projection member 338 provides user 300 with a sensory perception of where left foot 334 is relative to location of skateboard 330. This sensory perception may aid user 300 in controlling skateboard 330 while user 300 and skateboard 330 are elevated off ground surface 332.

Although the exemplary embodiment shown in FIGS. 8-9 shows a user engaged in a skateboarding maneuver where the top and/or sides of an upper contact the upper surface of a skateboard, in other embodiments the provisions discussed above can facilitate any other kinds of maneuvers. As another example, providing sensory feedback along the top and sides of the upper may be useful as a user performs maneuvers (e.g., skateboarding tricks) that require the top of the upper to engage the underside of the skateboard. Placing the top and/or sides of the upper in contact with a lower side of the skateboard may allow the upper to apply a force (such as a torque) to rotate, lift, or otherwise manipulate the board. The exemplary projection member system described here and shown in the figures may allow a user to more easily sense when the foot has contacted the underside of the skateboard, and/or an edge of the skateboard, to better provide feedback to the user during a maneuver.

In some embodiments, a projection member system may include projection members that vary from other projection members. By varying the projection members, a projection member system can be "tuned" to provide a distinctive textured surface for interacting with an object and its surface, for example the grip tape of a skateboard, which in turn provides a user with customized sensory feedback. For purpose of clarity, tuned or variants thereof, refer to adjusting the dimension sizes, distance (e.g. density), or locations of projection members relative to each other.

Figure 10:
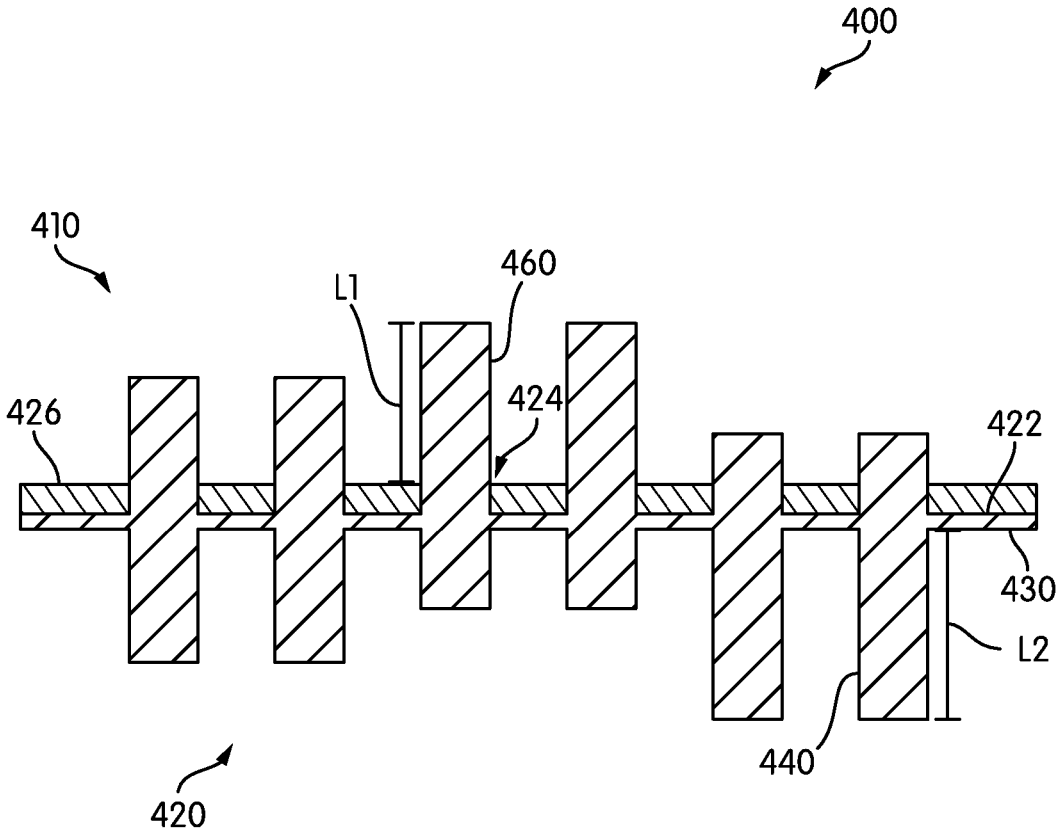
FIG. 10 is a side schematic view of an embodiment of a portion of a projection member system having projection members with varying lengths.

Referring to FIG. 10, a partial schematic side view of an exemplary projection member system 410 configured with an upper 400 is illustrated. Projection member system 410 includes projection members 420 having proximal projecting portions 440 and distal projecting portions 460 that have been tuned to varying lengths. In some embodiments, the length of distal projecting portions 460 extending away from first side 422 may be a first length L1. In some embodiments, distal projecting portions 460 may be disposed through apertures 424 and extend above outwardly facing surface 426 of upper 400. In some other embodiments, the length of proximal projecting portions 440 extending away from second side 430 and towards a user's foot (not shown) may be a second length L2 substantially different than first length L1 of distal projecting portions 460. In still some other embodiments, the lengths of projection members 420 extending from either first side 422 or second side 430 may be another different length. In some cases, where proximal projecting members 440 extending away from second side 430 have a longer length, the greater the sensation may be translated to a user's foot.

It is to be appreciated that several configurations or a combination of configurations may be used to tune the projection members of a projection member system. In some embodiments, tuning projection members, by varying the lengths, locations, and density, may provide a distinctive sensory feedback of objects that come into contact with an upper. It is further to be appreciated that having this sensory feedback may enable a user engaged in a skateboard maneuver, for example, to have better control and balance of the skateboard while performing the athletic activity.

Figure 11:
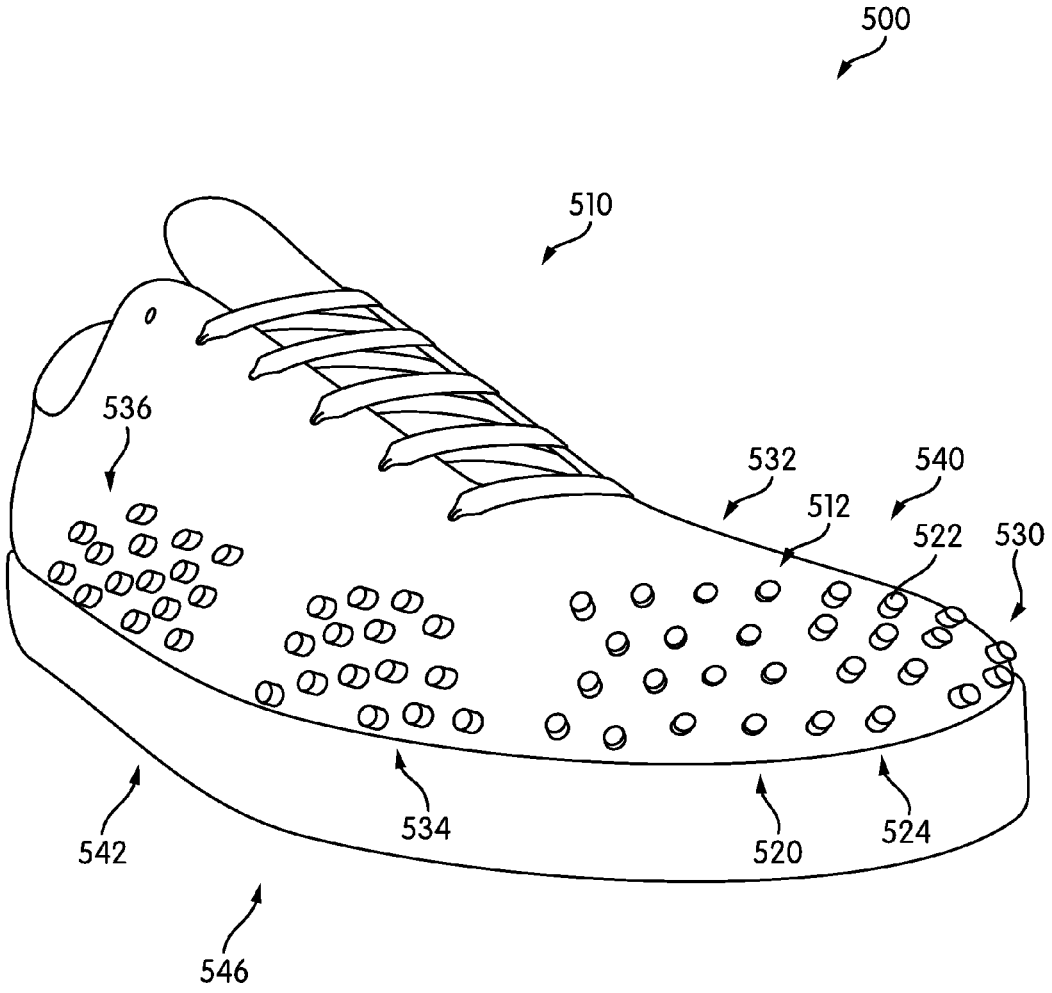
FIG. 11 is an isometric view of an embodiment article of footwear having projection members.

Referring to FIG. 11, an exemplary article 500 having upper 510 with a plurality of apertures 512 and projection member system 520 is shown. In some embodiments, the lengths of projection members 522 can be tuned differently, as shown for example in FIG. 10. In some embodiments, portions of the upper can be tuned by the placement of engagement zones.

In some embodiments, projection members 522 form textured surface 524 on the upper 510 defining engagement zone 530. In some embodiments, first engagement zone 532, second engagement zone 534, and third engagement zone 536 may be present. In some embodiments, first engagement zone 532 may have more projection members than second engagement zone 534, or third engagement zone 536. However, it is understood that each engagement zone 530 has more projection members 522 than portions of the upper outside the engagement zones (i.e., portions of the upper with zero projection members). In some other cases, upper 510 may contain additional engagement zones 530. In still some other cases upper 510 may contain fewer engagement zones 530.

In some embodiments, the locations of the engagement zone can be tuned for activities, such as skateboarding, where the upper is more likely to come into contact with surface of the skateboard. For example, first engagement zone 532 may be associated in the forefoot region 540 of upper 510 in the vicinity of a user's toes or instep area where a user is more likely to position their feet during skateboarding maneuvers, as shown for example in FIGS. 8 and 9. Second engagement zone 534 may be associated between forefoot region 540 and midfoot region 542 towards lateral side 546 of article 500. Third engagement zone 536 may be associated in the midfoot region 542 on lateral side 546 of article 500.

In some embodiments, a projection member system may include provisions that allow an individual projection member to move independently relative to an adjacent projection member within the engagement zone. In other words, even though a projection member is displaced because of a load, adjacent projection members may remain in place. Furthermore, in those embodiments, the provisions may allow for the interior portion of a base layer to remain flush, or in stay fixedly in contact, with the inwardly facing surface of an upper even as an adjacent projection member is displaced.

Figure 12:
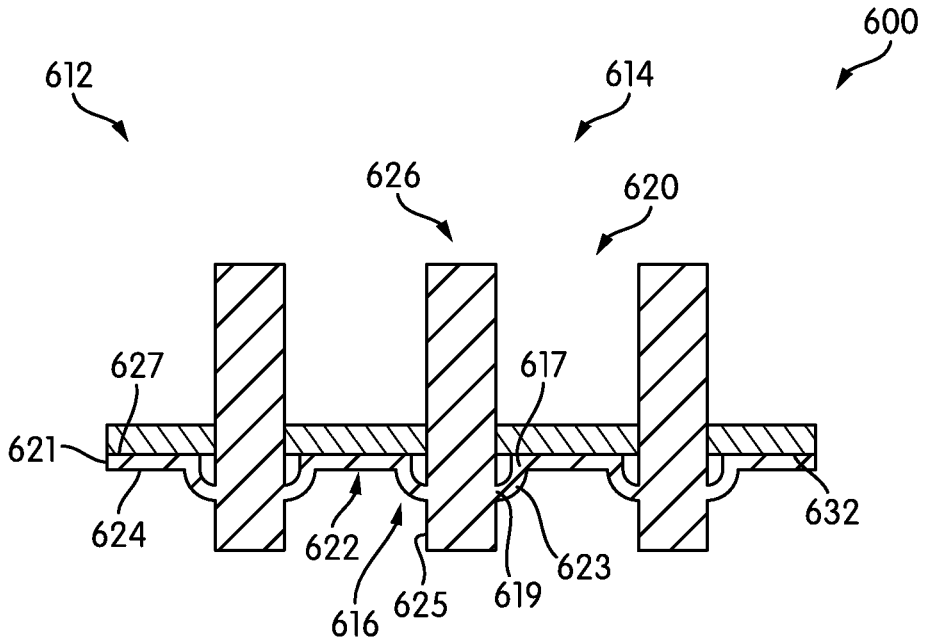
FIG. 12 is a side schematic view of an embodiment of a portion of a projection member system having connecting portions.
Figure 13:
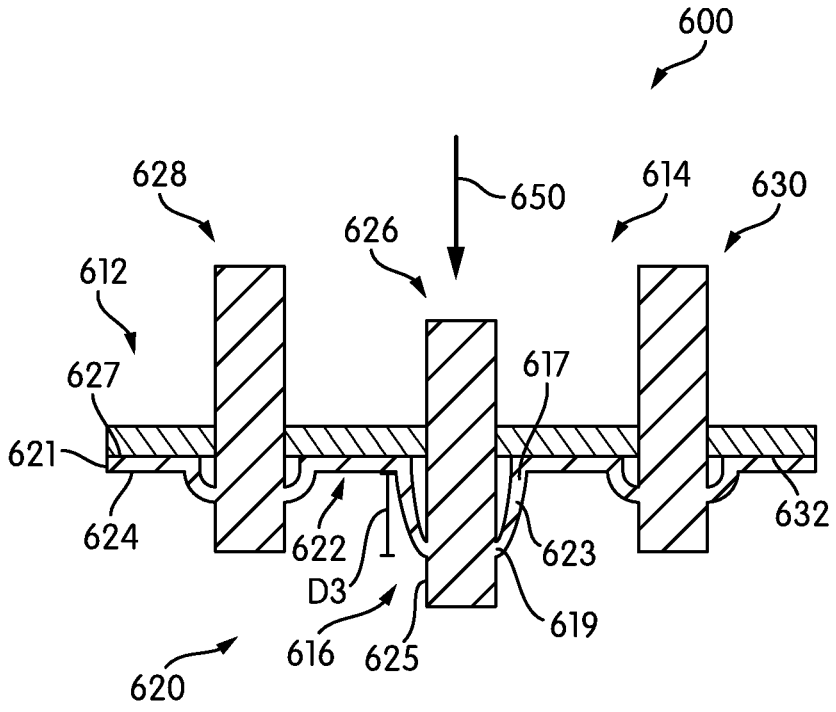
FIG. 13 is a side schematic view of an embodiment of a portion of a projection member system having connecting portions experiencing a load placed upon it.

FIGS. 12 and 13 are schematic side views illustrating an exemplary embodiment of a portion of an article 600 comprising an upper 612 with projection member system 614. In some embodiments, projection member system 614 may include a plurality of connecting portions 616. In some embodiments, connecting portions 616 are integrally formed with interior portions 622 on second side surface 624 of base layer 621. In some embodiments, connecting portions 616 may join base layer 621 with a plurality of projection members 620. In some embodiments, connecting portions 616 may comprise of a first connecting end 617 attached to second side 624 of base layer 621. In some other embodiments, connecting portion 616 may have a second connecting end 619 attached to proximal projecting portion 625 of projection members 620. In still some other embodiments, connecting portion 616 may have an intermediate portion 623 disposed between first connecting end 617 and second connecting end 619. It is to be understood that, although intermediate portion 623 is depicted in a relatively two-dimensional embodiment in FIGS. 12 and 13, intermediate portion 623 is a curved sidewall extending three- hundred-sixty degrees around projection members 620.

In this exemplary embodiment, first side surface 627 of base layer 621 is attached to inwardly facing surface 632 of upper 612 using any system known in the art. For example, in some embodiments, base layer 621 may be attached to upper 612 using any known methods to adhesively attach base layer 621 and upper 612 together. Therefore base layer 621 may remain fixedly in contact with inwardly facing surface 632 of upper 612, as projection member system 614 encounters load 650.

In some embodiments, when upper 612 comes into contact with a surface (not shown) of an object, load 650 causes first projection member 626 to be displaced a linear distance D3 in a proximal direction, relative to base layer 621, as shown in FIG. 13. However, because connecting portions 616, including intermediate portion 623, can be elastically deformed and therefore stretched, relative to inwardly facing surface 632, only first projection member 626 is displaced in a proximal direction, while second projection member 628, and third projection member 630 remain in place and are not pulled down.

Furthermore, because first side surface 627 of base layer 621 may be adhesively attached to inwardly facing surface 632 of upper 612, interior portion 622 next to first projection member 626 remains in contact with upper 612. That is, interior portion 622 is not displaced when first projection member 626 moves linear distance D3 caused by load 650.

While various embodiments have been described, the description is intended to be exemplary, rather than limiting and it will be apparent to those in the art that many more embodiments and implementations are possible that are within the scope of the current embodiments. Accordingly, the current embodiments are not to be restricted except in light of the attached claims and their equivalents. Features described in one embodiment may or may not be included in other embodiments described herein. Also, various modifications and changes may be made within the scope of the attached claims.

The invention claimed is:

1. An article of footwear, comprising:

an upper having an outwardly facing surface, and an inwardly facing surface opposite the outwardly facing surface, wherein the upper further includes a first aperture;

a sole structure secured to the upper;

a projection member system including a base layer and a first projection member;

wherein the base layer comprises a peripheral portion extending around a perimeter of the first base, and an interior portion surrounded by the peripheral portion, wherein the base layer further includes a first side, and a second side opposite the first side, wherein the first projection member is integrally formed with the base layer;

wherein the first projection member has a distal projecting portion that extends away from the first side and a proximal projecting portion that extends away from the second side;

wherein the distal projecting portion is disposed in the first aperture extending distally away from the outwardly facing surface of the upper;

wherein the peripheral portion of the base layer is attached to the upper;

wherein the projection member system has a first configuration where a proximal end of the first projection member is disposed a first distance from the inwardly facing surface of the upper, and a second configuration where the proximal end of the first projection member is disposed a second distance from the inwardly facing surface of the upper, and the second distance being greater than the first distance;

wherein the peripheral portion of the base layer contacts the inwardly facing surface in the first configuration and the second configuration;

wherein the interior portion of the base layer moves further from the inwardly facing surface when moving from the first configuration to the the second configuration.

2. The article according to claim 1, wherein the base layer includes a second projection member integrally formed with the base layer and wherein the upper further includes a second aperture spaced apart from the first aperture;

wherein the second projection member has a distal projecting portion that extends away from the first side and a proximal projecting portion that extends away from the second side; and wherein the distal projecting portion of the second projection member is disposed in the second aperture extending distally away from the outwardly facing surface of the upper.

3. The article according to claim 2, wherein a proximal end of the second projection member is disposed a third distance from the inwardly facing surface of the upper in the first configuration, and a fourth distance from the inwardly facing surface of the upper in the second configuration.

4. The article according to claim 3, wherein the third distance is substantially equal to the first distance.

5. The article according to claim 3, wherein the fourth distance is substantially different than the second distance.

6. The article according to claim 1, wherein the first projection member has a first length and the second projection member has a second length, and the first length and the second length are substantially different.

7. An article of footwear, comprising:

an upper having an outwardly facing surface, and an inwardly facing surface opposite the outwardly facing surface, the upper further including a first aperture;

a sole structure secured to the upper;

a projection member system including a base layer;

the base layer comprising a peripheral portion and an interior portion disposed inwardly of the peripheral portion, wherein the base layer also includes a first side and a second side opposite the first side;

the projection member system also including a first projection member, the first projection member including a proximal end and a distal end;

wherein the projection member system includes a first connecting portion, wherein the first connecting portion includes a first connecting end attached to the base layer and wherein the first connecting portion includes a second connecting end attached to the first projection member, wherein the second connecting end is attached to the first projection member between the proximal end and the distal end;

wherein the first connecting portion includes an intermediate connecting portion that is disposed between the first connecting end and the second connecting end;

wherein a portion of the first projection member including the distal end is disposed through the first aperture;

wherein the first side of the base layer is fixed to the inwardly facing surface of the upper and wherein the intermediate connecting portion of the first connecting portion is capable of moving relative to the inwardly facing surface; and wherein the first projection member can be displaced in a proximal direction when a force is applied to the distal end of the first projection member.

8. The article according to claim 7, wherein the first connecting portion stretches relative to the inwardly facing surface when the first projection member is displaced in the proximal direction.

9. The article according to claim 7, wherein the projection member system further includes a second projection member and a second connecting portion; wherein the second projection member includes a proximal end and a distal end.

10. The article according to claim 9, wherein the second connecting portion includes a third connecting end attached to the base layer and wherein the second connecting portion includes a fourth connecting end attached to the second projection member, wherein the fourth connecting end is attached to the second projection member between the proximal end and the distal end.

11. The article according to claim 10, wherein the second projection member can be displaced in the proximal direction when a force is applied to the distal end of the second projection member.

12. The article according to claim 11, wherein the first projection member moves independently of the second projection member when a force is applied to the distal end of the first projection member.

13. The article according to claim 7, wherein the first connecting portion has a curved sidewall extending three-hundred-sixty degrees around the first projection member.

14. An article of footwear, comprising:

an upper having an outwardly facing surface, an inwardly facing surface opposite the outwardly facing surface, wherein the inwardly facing surface faces an interior of the upper and the upper further includes an aperture;

a sole structure secured to the upper;

a projection member system comprising a projection member including:

a proximal projecting portion extending toward the interior of the upper and having a proximal end; and a distal projecting member extending through the aperture in a direction opposite the proximal projecting portion, wherein the distal projecting portion has a distal end;

a base layer, wherein the distal projecting portion extends away from a first side of the base layer and the proximal projecting portion extends away from a second side of the base layer that is opposite the first side;

wherein the projection member is configured to retract towards an interior of the upper such that the proximal end is displaced toward the interior of the upper when a force is applied to the distal end; and wherein the proximal end is configured to contact a foot when the projection member retracts toward the interior of the upper, thereby alerting a wearer of the article of footwear to the force applied at the distal end.

15. The article according to claim 14, wherein the projection member is made from a polymer material and wherein the projection member system has a first configuration where a proximal end of the first projection member is disposed a first distance from the inwardly facing surface of the upper, and a second configuration where the proximal end of the first projection member is disposed a second distance from the inwardly facing surface of the upper, and the second distance being greater than the first distance.

16. The article according to claim 15, wherein the base layer further comprises a peripheral portion extending around a perimeter of the first base and an interior portion surrounded by the peripheral portion, and wherein the peripheral portion of the base layer contacts the inwardly facing surface in the first configuration and the second configuration.

17. The article according to claim 14, wherein the projection. member is configured to retract towards the exterior of the upper after the force is removed from the distal end.

18. The article according to claim 16, wherein the interior portion of the base layer contacts the inwardly facing surface in the first configuration.

19. The article according to claim 14, wherein the interior portion is spaced apart from the inwardly facing surface in the second configuration.

* * * * *